United States Patent [19]
Welti
[11] 4,201,992
[45] May 6, 1980

[54] MULTIBEAM COMMUNICATIONS SATELLITE

[75] Inventor: George R. Welti, Leesburg, Va.
[73] Assignee: Communications Satellite Corporation, Washington, D.C.

[21] Appl. No.: 898,051
[22] Filed: Apr. 20, 1978
[51] Int. Cl.² ..... H01Q 1/28
[52] U.S. Cl. ..... 343/840; 343/100 ST; 343/DIG. 2
[58] Field of Search ..... 343/DIG. 2, 100 ST, 343/779, 781 R, 735, 840

[56] References Cited

U.S. PATENT DOCUMENTS 3,922,682 11/1975 Hyde ..... 343/840

*Primary Examiner*—Eli Lieberman
*Attorney, Agent, or Firm*—Sughrue, Rothwell, Mion, Zinn and Macpeak

[57] ABSTRACT

A multibeam communications satellite uses a dish-shaped reflector whose surface is a surface of revolution generated by rotating a plane parabola about an axis of revolution located in the plane of the parabola but angularly displaced from the axis of symmetry thereof. The line of revolution of the focal point of the parabola defines a focal circle, and a feed located on the focal circle will illuminate an area lying on a circle near the edge of the earth's apparent disc. Since every plane in which the axis of revolution lies is a plane of symmetry, the antenna exhibits good cross polarization cancellation, making the satellite particularly useful in frequency reuse communications systems.

5 Claims, 3 Drawing Figures

MULTIBEAM COMMUNICATIONS SATELLITE

BACKGROUND OF THE INVENTION

The present invention relates to spot-beam satellite communications systems and, more particularly, to improvements in such systems afforded by the use of an antenna reflector and feed arrangement designed to provide multiple narrow beams, each capable of reusing the same spectrum.

In order to achieve greater communications capability, a number of multiple access satellite communications systems have been devised, one of which, described in U.S. Pat. No. 3,928,804, is known as space division multiple access. In such a system, a plurality of beams, commonly known as "spot" beams, illuminate specific areas of the earth's surface. Since the beams do not overlap, the same frequency band may be used for each beam, thus permitting increased use of the available bandwidth. In order to satisfy increasing communications demand, it is necessary to illuminate a large number of discrete areas from a single satellite. Since dedicating a separate reflector to each illuminated area would result in a very large and cumbersome arrangement of reflectors which would be difficult to deploy, a number of systems have been designed to which a common reflector is shared by a plurality of feeds. The multiple feeds may be arranged to direct radiation at the reflector from different angles so that each feed will illuminate a different area on the earth.

The sharing of a common reflector by a plurality of feeds does not, in itself, provide a complete solution to the above-mentioned problem—i.e., illuminating a large number of discrete areas from a single satellite. Reflector and feed arrangements of the type used until now have only been capable of satisfactorily illuminating one-half of the earth's hemisphere visible from the satellite, and, thus, more than one reflector is needed. In addition to problems encountered in deploying the multiple reflectors, the reflectors may differ in size or be unequally spaced around the satellite, thus causing imbalances which may significantly decrease the useful life of the satellite. For example, the torque imparted to the satellite by the sun's rays may cause an increase in fuel consumption to maintain the orientation of the satellite. Also, the heat generated by the absorption of the sun's rays may be greater on some parts of the satellite than others, thus causing thermal stresses in the satellite structure.

Some systems, e.g., ATS-6 satellites, utilize symmetrically illuminated paraboloidal reflectors. However, in these systems, the feeds are positioned within the radiating aperture of the reflector, and large side lobes occur in the far-field radiation pattern due to the blockage of the radiating aperture.

Other systems, e.g., ANIK, INTELSAT IV-A and INTELSAT V satellites, utilize offset-fed paraboloidal reflectors in which each of the feeds illuminates a section of the reflector offset from the vertex of the parabola. In these systems, the feeds are not located within the radiating aperture, and, consequently, no aperture blockage occurs. However, these systems do exhibit the above-mentioned disadvantage of being effective over only one-half of the earth's visible hemisphere. This is due to the increase in aberration, or defocussing, of the radiated beam which occurs as the offset of the feed from the focus of the paraboloid is increased. The defocussing of the antenna beams also results in poor cross-polarization cancellation. This means that these systems are not particularly adaptable to frequency reuse systems employing orthogonally polarized antenna beams.

SUMMARY OF THE INVENTION

It is an object of this invention to provide a single communications satellite reflector which is capable of providing effective coverage of all areas visible from the satellite.

It is a further object of this invention to provide such a satellite reflector which is easily deployed and minimizes spacecraft imbalance.

Briefly, the reflector according to the present invention is a dish-shaped reflector whose surface is a surface of revolution generated by rotating a plane parabola about an axis located in the plane of the parabola but angularly displaced from the axis of symmetry thereof. A plurality of feedhorns are positioned near the focal circle of the reflector and preferably upon the conical region defined by the focal line of the parabola rotated about the axis of revolution. The angle between the axis of revolution and the axis of symmetry of the parabola is preferably about 8° so that feeds positioned on the focal circle of the reflector will illuminate regions lying along a circle near the edge of the earth's apparent disc—i.e., near the edge of the earth's visible hemisphere.

DETAILED DESCRIPTION OF THE DRAWING

Figure 1:
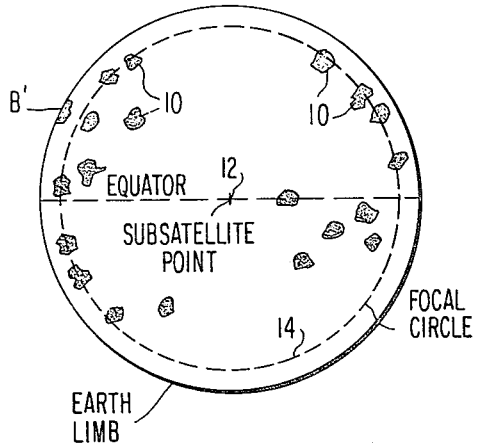
FIG. 1 is a view of the earth as seen from a geostationary communications satellite.

As viewed from a satellite, the earth appears as a two-dimensional disc, and, in many instances, for example, in satellites used mainly for intercontinental communications, the large population centers are located not in the center of the earth's apparent disc but near its edge or "limb," as shown in FIG. 1. In order for a conventional single reflector, e.g., an offset paraboloidal reflector of the type described above, to illuminate all of the high population density areas 10, the antenna would have to be focussed at the subsatellite point 12—i.e., it would have to be oriented with its axis of symmetry pointing at the subsatellite point 12 so that a beam radiated from a feed positioned at the focus of the reflector would cover or "illuminate" the subsatellite point 12. Other feeds would then be positioned at various positions offset from the reflector focus so that their beams would illuminate respective population centers 10. However, when a feed is positioned far enough from the focus to illuminate an area out near the edge of the earth's apparent disc, the aberration of the beam would become unacceptable.

The reflector according to the present invention is designed to focus not on a simple point 12 but instead along a circle 14 near the earth's limb so that most of the feeds need only be positioned very slightly off-axis, thus substantially reducing the amount of defocussing of the radiated beam. A reflector configuration suitable for illuminating such a circle is a paraboloidal torus reflector.

The general concept of a paraboloidal torus reflector per se does not constitute a part of this invention, as such reflectors are known in the art. For example, a general description of paraboloidal torus reflectors may be found in *Antenna Engineering Handbook,* edited by H. Jasik, McGraw-Hill, Inc., 1961. An analysis of a paraboloidal torus reflector as used in a satellite communications system can be found in U.S. Pat. No. 3,852,763. In that patent, the reflector surface of an antenna is formed by rotating a plane parabola about an axis of revolution angularly displaced from its axis of symmetry by an angle $\alpha$. The antenna disclosed therein is a terrestrial antenna which must track a communications satellite as the latter moves along the geostationary orbit. When the terrestrial antenna is removed a great distance from the equator, a conical scan is required to track the satellite. This can be accomplished by utilizing a torus type reflector in which the angle $\alpha$ is fairly large, with 95.5° being optimum for the continental United States. Such an antenna could not be used on a satellite because the angle of the conical scan would not provide any effective coverage of the earth. Thus, although the use of paraboloidal torus reflectors for performing a conical scan is known, the satellite antenna system according to the present invention uses such a reflector having a very narrow angle $\alpha$ in order to illuminate a 360° circle near the edge of the earth's apparent disc. Such an antenna provides a scanning capability heretofore unavailable.

Figure 2:
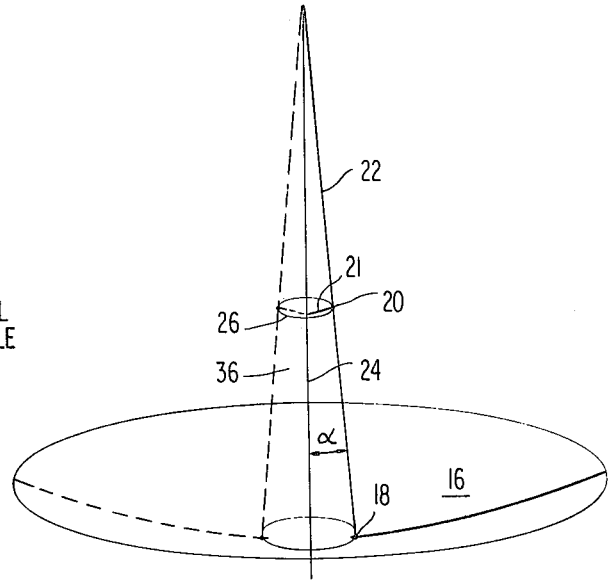
FIG. 2 is an illustration showing the relationship between the generating curve and axis of revolution used to form the reflector according to the present invention.

The shape of the reflector used in the antenna according to the present invention can be more clearly understood by referring to FIG. 2. The reflector surface is formed by taking a plane parabola 16 having an apex 18, a focus 20 and an axis of symmetry 22 and rotating the parabola about an axis of revolution 24 angularly displaced from the axis of symmetry 22 by an angle $\alpha$. A set of points will be generated uniformly around the axis of rotation 24, and the result will be a torus-shaped parabolic surface 16 having a locus of focal points 20 defining a focal circle bounding a conical-shaped surface 26 formed by the line segment 21 as it is rotated about the axis of revolution 24. The line segment 21 is the focal line of the parabola. The torus-shaped surface 16 is characterized by the fact that every plane containing the axis of revolution 24 is a plane of symmetry of the surface 16.

Figure 3:
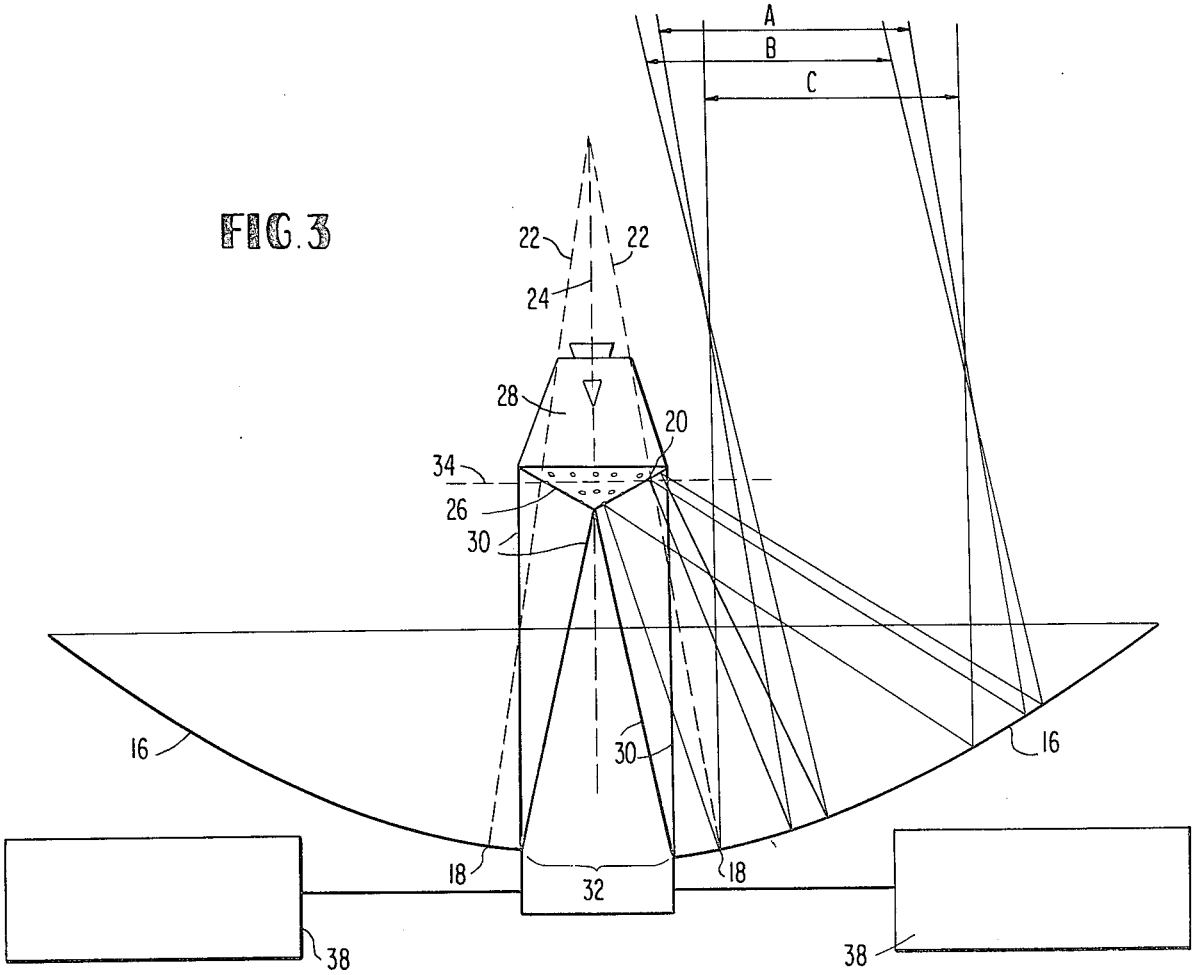
FIG. 3 is a side view of the feed-and-reflector arrangement according to the present invention.

The communications satellite according to the present invention is illustrated in FIG. 3. A housing 28 containing the feed equipment is supported on struts 30 directly above the blocked central region 32 of the torus-shaped parabolic reflector 16. A plurality of feeds are located on the lower surface of the housing 28, which surface is the conical-shaped surface generated by the focal line 21 as it is rotated about the axis of revolution 24 in FIG. 2. A beam incident on a parabola along a line parallel to its axis of symmetry will be focussed at the focal point of the parabola. As the beam is moved off-axis, defocussing, or aberration, occurs, but the aberrated focal point will move along focal line 21 in FIG. 2. By placing the feeds on a surface generated by the focal line, aberration of the radiated beams will be minimized. Because of the inherent symmetry of the torus-shaped reflector 16, the antenna exhibits good cross-polarization cancellation. Thus, the satellite system according to the invention is particularly useful in frequency reuse systems employing orthogonally polarized antenna beams.

With all of the feedhorns positioned within the conical-shaped region 36 bounded by the rotation of axis of symmetry 22 about the axis of rotation 24 and on the conical surface 26, aperture blockage will be eliminated. It should be noted, however, that it is not necessary for all of the feeds to be located below the line 34, nor is it necessary for the housing 28 to be completely contained within the conical region 36, but the location of the feeds, the size of the housing 28 and the geometry of the reflector 16 must be chosen so that the beams directed to areas at the earth's limb will not strike the housing 28. In the embodiment shown in FIG. 3, some of the feedhorns are positioned slightly outside of the conical region 36 in order to facilitate illumination of areas outside the circle 14 shown in FIG. 1. But as long as the feedhorns are substantially within this region, aperture blockage will be avoided. A pair of solar panels 38 may be extended from either side of the reflector for providing electrical power to the feed equipment in the housing 28.

Each of the feeds will illuminate a substantially circular portion of the reflector 16, and the angle $\alpha$ in FIG. 2 is chosen such that a beam A generated by a feed located on the focal circle of the reflector will exit the reflector parallel to an axis of symmetry 22 thereof and illuminate an area situated on the circle 14 of FIG. 1 which passes nearest to most of the population centers to be served. A beam B originating from a feed located at a predetermined position slightly outward of the focus 20 will illuminate an area, e.g., B′ in FIG. 1, which is slightly outside of the circle 14 near the edge of the earth's apparent disc. A beam C originating from a feed located at a predetermined position substantially inward of the focus 20 will exit the reflector parallel to the axis of revolution 24 and will illuminate the subsatellite point 12 in FIG. 1. The exact position of each feed will be determined by the area which it is to illuminate.

Since most of the population centers are located very close to the circle 14, the feeds can illuminate most of the areas while being only very slightly displaced from the focal circle of the reflector, thus minimizing the aberration or defocussing which is proportional to the feed offset. The areas located in the vicinity of subsatellite point 12 in FIG. 1 will require feeds which are offset substantially from the focus of the reflector, and, therefore, significant aberration may occur, but these areas are often oceanic.

The size of the circle 14 in FIG. 1 can be controlled by changing the angle $\alpha$ in FIG. 2. The circle 14 of FIG. 1 exists for an angle $\alpha$ of approximately 8°, and, if most of the population centers 10 are located further inward from the earth's limb, the diameter of the circle 14 may be decreased by decreasing the value of angle $\alpha$. It should be understood that the diameter of the circle 14 will continually decrease with decreasing angle $\alpha$, and for $\alpha=0°$, the reflector would become a dish-shaped parabolic reflector focused on the subsatellite point 12. Increasing the angle $\alpha$ will soon cause the diameter of the circle 14 to exceed the diameter of the earth, and, therefore, it is undesirable to increase angle $\alpha$ beyond approximately 12°.

The reflector according to the present invention minimizes the degradation of the far-field radiation pattern, which usually results from off-axis beam pointing, by orienting the axis 22 of the parabola as close as possible towards the most densely covered regions of the earth, which tend to be located near the earth's limbs.

The reflector is a torus-type reflector, but the open region at the center of the reflector is small in comparison to the overall reflector size so that the relatively simple methods of deploying conventional parabolic dish reflectors may be used. Furthermore, the symmetry of the reflector minimizes the solar torque and thermal imbalances which are commonplace in conventional antenna systems.

While I have shown and described one embodiment of my invention, it should be appreciated that various changes and modifications may be made without departing from the spirit of my invention. For example, the transmitting equipment, rather than being located immediately behind the feed area as shown in FIG. 3, may be mounted behind the apex of the reflector and coupled to the feeds through the blocked central region of the reflector. The critical feature of the present invention which must be preserved is the shape of the reflecting surface and feed area.

What is claimed is:

1. In a multibeam communications satellite of the type having an antenna which comprises a reflector and a plurality of feeds for directing radiation at different areas of the surface of said reflector for redirection to various points on earth, the improvement comprising said reflector surface being described by a plane parabolic generating curve rotated about an axis of revolution which is coplanar with said generating curve but angularly displaced from the axis of symmetry thereof by an angle of less than 12°.

2. The improvement in a multibeam communications satellite according to claim 1 wherein the size of the angle between said axis of revolution and said axis of said symmetry is chosen so that when said axis of revolution is aligned with the center of the earth's apparent disc, the axis of symmetry of said parabola defines a circle on said disc as it is rotated about said axis of revolution.

3. The improvement in a multibeam communications satellite according to claim 2 wherein said angle is approximately 8°.

4. The improvement in a multibeam communications satellite according to claim 2 wherein said plurality of feeds are positioned substantially within a region defined by said axis of symmetry as it is rotated about said axis of revolution.

5. The improvement in a multibeam communications satellite according to claim 1 wherein the plurality of feeds are positioned on a conical surface defined by the focal line of said parabola as it is rotated about said axis of revolution.

* * * * *